US007836658B2

(12) United States Patent
Perrot, Jr.

(10) Patent No.: US 7,836,658 B2
(45) Date of Patent: Nov. 23, 2010

(54) ROOF FLASHING

(76) Inventor: John J. Perrot, Jr., 1121 N. Sibley St., Metairie, LA (US) 70003

( * ) Notice: Subject to any disclaimer, the term of this patent is extended or adjusted under 35 U.S.C. 154(b) by 106 days.

(21) Appl. No.: 12/321,303

(22) Filed: Jan. 16, 2009

(65) Prior Publication Data

US 2010/0180517 A1 Jul. 22, 2010

(51) Int. Cl.
*E04D 1/36* (2006.01)

(52) U.S. Cl. ..... 52/741.4; 52/62; 52/58; 52/97; 52/408; 52/748.1

(58) Field of Classification Search ..... 52/408, 52/58, 61, 62, 300, 746.12, 748.1, 59, 409, 52/97, 410, 96, 741.4
See application file for complete search history.

(56) References Cited

U.S. PATENT DOCUMENTS

| | | | | | |
|---|---|---|---|---|---|
| 1,910,605 | A | * | 5/1933 | Hansberry | 52/59 |
| 2,112,332 | A | * | 3/1938 | Cox | 52/59 |
| 2,226,886 | A | * | 12/1940 | Willis | 52/62 |
| 2,857,861 | A | | 10/1958 | Trostle | |
| 3,086,324 | A | * | 4/1963 | Cheney | 52/96 |
| 3,093,931 | A | * | 6/1963 | Waring | 52/96 |
| 3,187,464 | A | * | 6/1965 | Sharp | 52/716.1 |
| 3,608,255 | A | * | 9/1971 | Chomes | 52/61 |
| 3,735,540 | A | | 5/1973 | Thaler | |
| 3,905,165 | A | | 9/1975 | Kneisel | |
| 3,979,860 | A | * | 9/1976 | Roth et al. | 52/61 |
| 4,037,372 | A | * | 7/1977 | Patry | 52/96 |
| 4,424,650 | A | | 1/1984 | Van Note | |
| 4,483,112 | A | | 11/1984 | Rueblinger | |
| 4,557,081 | A | * | 12/1985 | Kelly | 52/94 |
| 4,598,507 | A | * | 7/1986 | Hickman | 52/94 |
| 4,662,129 | A | * | 5/1987 | Hickman | 52/96 |
| 4,709,518 | A | * | 12/1987 | Lane | 52/94 |
| 4,759,157 | A | | 7/1988 | Webb et al. | |
| 4,780,999 | A | | 11/1988 | Webb et al. | |
| 4,848,045 | A | * | 7/1989 | Nichols et al. | 52/60 |
| 4,964,248 | A | * | 10/1990 | Braine et al. | 52/60 |
| 5,031,374 | A | | 7/1991 | Batch et al. | |
| 5,251,411 | A | * | 10/1993 | Kelley et al. | 52/60 |
| 5,394,672 | A | | 3/1995 | Seem | |
| 5,586,414 | A | * | 12/1996 | Tawzer | 52/57 |

(Continued)

*Primary Examiner*—Robert J Canfield
*Assistant Examiner*—Babajide Demuren
(74) *Attorney, Agent, or Firm*—Keaty Law Firm

(57) ABSTRACT

A flashing assembly for reinforcing an interface defined between a roof and a portion of a building wall, either a flat roof or a flat roof with parapet wall. The flashing assembly has a first member configured for securing along the interface between the roof and the building wall and a second member for covering an upper part of the first member. The first member has an inner vertical part adapted for extending along the building wall, a locking flange extending at a right angle to the inner vertical part, and an outer vertical part extending in a substantially parallel orientation to the inner vertical part. In one aspect, the first member has an inclined bottom flange for diverting water away from the building while the top locking flange is secured to the roof. In another aspect, the flashing assembly has a top locking flange that is sealed in a groove formed in a parapet wall above the roof and a securing bottom flange, which is attached to the roof.

2 Claims, 2 Drawing Sheets

U.S. PATENT DOCUMENTS 5,619,827 A * 4/1997 Church ..... 52/60
5,927,023 A 7/1999 Kittilstad
5,979,123 A * 11/1999 Brockman ..... 52/101
6,845,590 B1 1/2005 Mills
6,912,814 B1 * 7/2005 Inzeo et al. ..... 52/60
2003/0061771 A1 * 4/2003 Kintop ..... 52/97
2003/0177736 A1 * 9/2003 Gatherum ..... 52/741.1
2005/0126099 A1 * 6/2005 Kelly ..... 52/412
2007/0074466 A1 * 4/2007 Rasmussen ..... 52/97

* cited by examiner

ROOF FLASHING

BACKGROUND OF THE INVENTION

This invention relates to the construction industry, and more particularly, to roof flashings of the type which reinforce the interface between a wall and a roof edge to provide a waterproof and weather resistant seal along the edge of the roof.

Roof flashing is conventionally used to provide a waterproof and weather resistant seal about the periphery of the roof edge, as well as around the pipes and vent stacks. The flashing is usually made of sheet metal, flexible molded rubber or other synthetic material formed in an appropriate shape to seal the periphery of the projecting members, and is normally made to extend slightly above the level of the roof, to limit the infiltration of moisture into the building. In flat roofs, the roof edge is conventionally sealed using the so-called cant strips. Generally, roof systems used on most building structures, and particularly flat-roof buildings, require some type of blocking to provide a base for the attachment of roofing components, such as nailed down cant strips, that are used for parapet walls, skylight curbs or other construction details forming substantially 90 degree angles with a roof decking.

Typically, cant strips have been made of wood or a wood fiber material and have had triangular shaped cross sections thereby providing a 45-degree angle instead of the 90-degree angle that is created between a parapet wall and the roof. However, the triangular cross sectioned cant strips create a stressful angle for the membranes to follow as the transition from the horizontal roofing deck to the triangular cross sectioned cant strip still requires a transition angle of 45 degrees and this often is too much angle for the roofing membrane to handle over time. In particular, asphalt membranes still have a tendency to crack and split at the 45-degree angle between the horizontal decking surface and the cant strip surface.

Second, as the cant strip is made of wood or wood fiber material, they can absorb water and decompose if small cracks in the membrane go undetected and water penetrates to the cant strip surface. The cant strip can hold this moisture and subsequently promote dry rot of wood decking, sheathing or structural members. Third, the cant strip positioning is labor intensive, requiring four steps of cutting material and securing to the parapet wall. Once the cant strip is installed, a counter flashing should be cut into the wall and overlap the top edge of the roof membrane, secured to the parapet wall.

In flat roofs, the danger of the wind force lifting the roof edge and of standing water seeping in the cracks between the cant strips and the parapet wall remains high. It is critical to provide a long lasting, water tight seal of any gap that exists between the flashing and the projecting member. Commonly, such gaps are sealed by caulking with resilient materials, such as silicon. However, caulking can only be used in the locations where a narrow gap exists. Moreover, the roof flashing and stack members may move relative to each other due to weather conditions, which causes cracks in the caulk material, thus creating additional area for moisture penetration. Further, caulking can be difficult to work with, can have a limited effective lifetime, and can be expensive. Moreover, its installation is labor-intensive.

The present invention contemplates elimination of drawbacks associated with conventional roof systems and provision of a roof flashing assembly that can be used at the interface of a building roof and a wall, along the roof edge to securely seal the area between the building wall and the roof structure.

SUMMARY OF THE INVENTION

It is, therefore, an object of the present invention to provide a roof flashing assembly that can be used along the roof edge to prevent wind forces from acting on the roof edge and to prevent moisture from destroying the interface between the building wall and the roof structure.

It is another object of the invention to provide a roof flashing assembly that can be used along parapet roofs for sealing the 90-degree wall surface extensions in a simplified cost-efficient manner.

These and other objects of the invention are achieved through a provision of a flashing assembly for reinforcing an interface defined between a roof and a portion of a building wall, wherein said roof comprises a roof substructure and a roofing membrane covering the roof substructure. According to the first embodiment, the flashing assembly comprises a first member configured for securing along the interface between the roof and the building wall, said first member having an inner vertical part adapted for extending along the building wall, a locking flange extending at a right angle to the inner vertical part, an outer vertical part extending in a substantially parallel orientation to the inner vertical part, and a second member configured for covering an upper part of the first member, said second member extending at least in part along the outer vertical part.

The first member is secured to the roof such that the locking flange is fitted between the roof substructure and the roofing membrane, and the second member is secured to the roof by having the top horizontal portion thereof to extend over the roofing membrane.

According to the second embodiment, the flashing assembly is configured for reinforcing the interface between a roof of a building and a parapet wall. In this embodiment, the locking flange fits into a groove formed in the parapet wall a distance above the roof. The bottom transverse flange is attached to the roof, while the cap covers the upper part of the first member.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
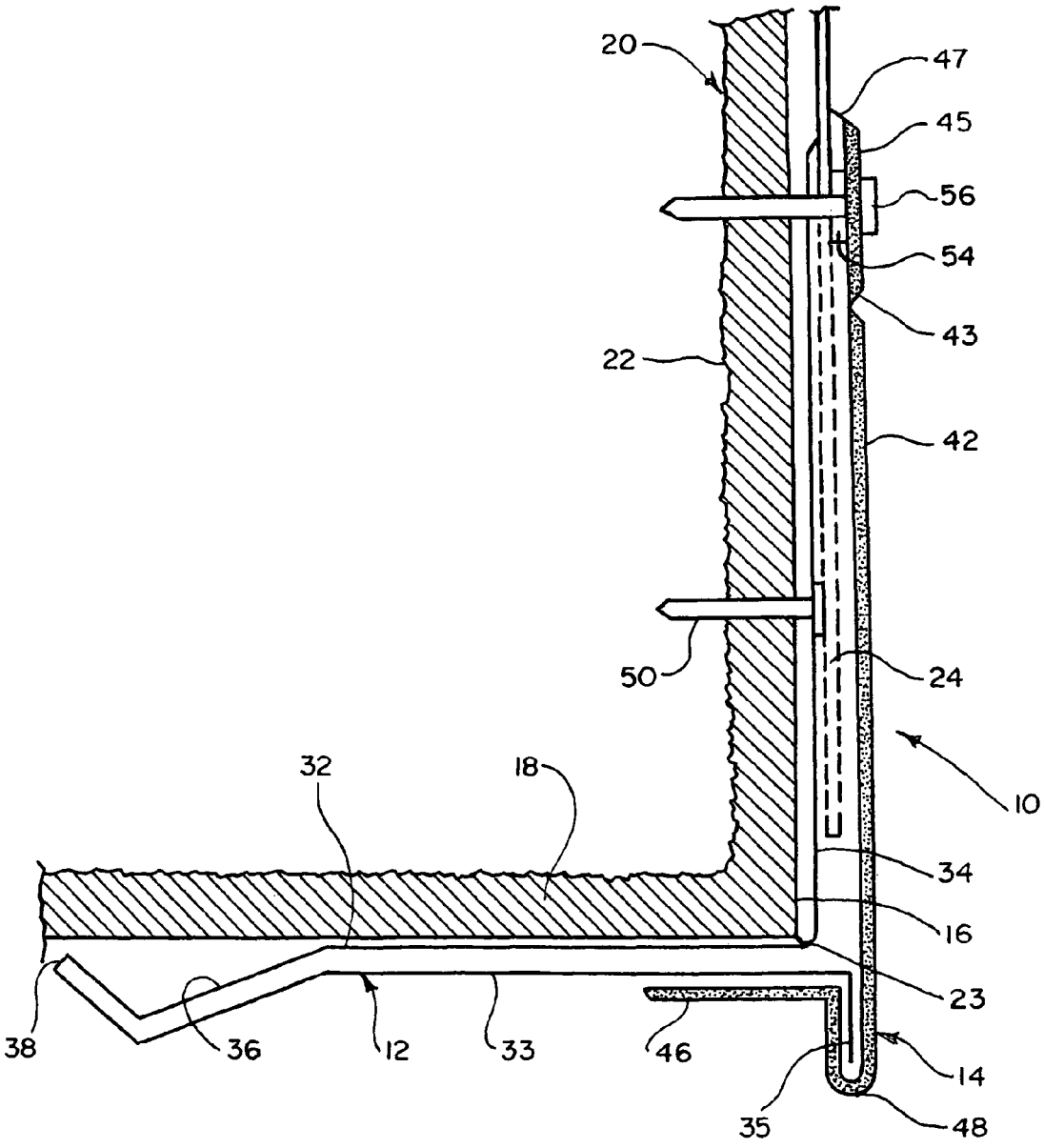
FIG. 1 is an end view of the flashing assembly according to the first embodiment of the present invention with the building structure shown in cross-section.

Turning now to the drawings in more detail, numeral 10 designates the edge flashing assembly according to the first embodiment of the invention. The flashing assembly 10 comprises a first flashing member 12 and a second flashing member, or cap 14 adapted for installation at the top 16 of a vertical wall 18. The system 10 is secured to a building 20 having a number of side walls 18 and a roof substructure 22. The system 10 is designed to be secured to the building 20 at the intersection or joining of the walls 18 and the roof 22 in order to provide a more water- and air-tight attachment of a roofing material or membrane 24 along the peripheral edge of the building structure 20.

The first member 12 comprises an inner vertical part 32 and an outer vertical part 33, a locking flange 34 extending perpendicularly to the top of the inner vertical part 32, and a sealing flange 35, which extends perpendicularly to the outer vertical part 33 in a direction opposite to the locking flange 34. The lower ends of the inner vertical part 32 and the outer vertical part 33 converge to form a generally V-shaped integral inclined bottom flange 36. The bottom flange 36 extends outwardly from the vertical parts 32, 33, with the bottom tip 38 of the flange 36 being oriented toward the vertical parts 32, 33 and toward the wall 18 of the building structure 20. The bottom flange 36 is designed to divert water away from the building wall 18.

The second member or cap 14 comprises an elongated top portion 42 which extends in a substantially parallel orientation in relation to the locking flange 34 when the cap 14 is engaged with the first member 12. An indentation 43 is formed in the top portion 42 adjacent to a distant end 45. The end 45 is cut an angle, defining an end surface 47, which is inclined at an angle in relation to the longitudinal axis to the top portion 42.

The second member 14 also comprises a vertical leg 46, which is integrally connected to the top portion 42 through a connecting part 48. The connecting part 48 forms a U-shaped channel which is adapted to receive and engage the sealing flange 35 of the first member 12. As can be seen in FIG. 1, the downwardly depending leg 46 is oriented in a substantially parallel orientation to the inner vertical part 32 and the outer vertical part 33.

It will be understood that the first member 12 and the second member 14 are elongated strips that can be cut into a desired length in a horizontal aspect to accommodate the roof extensions of the building structure 20.

During installation, the locking flange 34 is secured to the roof substructure 22 by mechanical means such as galvanized nails or screws 50. The roofing material 24 is then installed in contact with the locking flange 34. In this position, the locking flange 34 is sandwiched between the roof substructure 22 and the roofing material 24. When the first member 12 is properly installed the right angle formed at the intersection of the locking flange 34 and the inner vertical part 32 is positioned at a corner 23 of the roof substructure 22.

Once the first member 12 is installed, the cap 14 is placed to overlay the roofing material 24 along substantially entire lateral extension of the locking flange 34. If desired, a strip 54 of adhesive material, such silicone, can be deposited on the bottom surface of the top portion 42 to seal the area of attachment of the top portion to the roofing material 24. The cap 14 can then be attached by mechanical means, such as nails or screws 56, to the roofing material 24, the locking flange 34 and the roof substructure 22. The nail 56 can be driven through the adhesive material 54.

The sealing flange 35 is received in the channel formed by the connecting part 48. The outwardly extending flange 36 diverts water away from the walls 18, while the inwardly oriented tip 38 prevents the wind from lifting the bottom edge of the first member 12.

Figure 2:
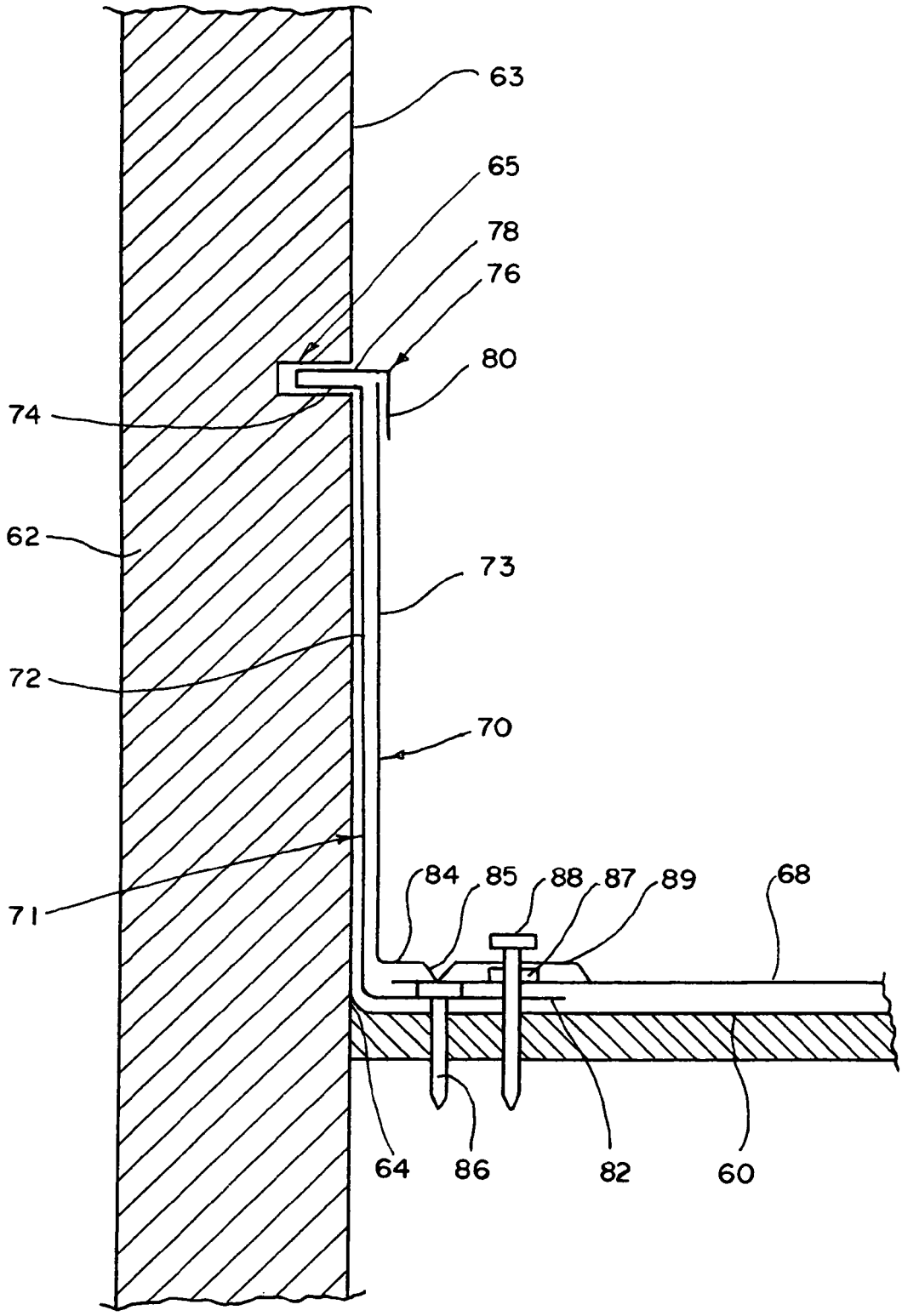
FIG. 2 is an end view of the flashing assembly according to the second embodiment of the present invention with the parapet wall shown in cross-section.

Turning now to the second embodiment of this invention, reference will be made to FIG. 2, which illustrates a flashing assembly particularly adapted for use with parapet walls. As can be seen in the drawing, the roof substructure 60 joins a parapet wall 62 along a line 64. The roof substructure 60 can be made of plywood or other suitable material. A roofing membrane or roofing material 68 covers the roof substructure 60.

The parapet wall 62 usually extends at a right angle to the roof substructure 60. As discussed above, the conventional technique would be to place a cant strip along the line 64. However, a strong wind can rip off the roof, breaking the cant strip. The plywood roof substructure 60 then becomes exposed to the environment. The present invention contemplates reinforcement of the weak point—the 90-degree connection between the roof and the parapet wall. According to the present invention, a flashing assembly 70 is placed along the line 64 extending up the parapet wall surface 63 and over a portion of the roof.

The flashing assembly 70 comprises a first member 71 having an inner vertical part 72 and an outer vertical part 73, and a locking flange 74 extending perpendicularly to the top of the inner vertical part 72. The locking flange 74 fits into a groove 65 formed in the parapet wall surface 63 a distance above the line 64. If desired, the locking flange 74 can be adhesively sealed in the groove 65.

The second member or cap 76 comprises an elongated top portion 78 which extends in a substantially parallel orientation in relation to the locking flange 74 when the cap 76 is engaged with the first member 71. The cap 76 further comprises a vertical leg 80, which extends downwardly from the top portion 78 and overlaps the top edges of the inner vertical part 72 and the outer vertical part 73.

A first securing flange 82 is formed by a lower portion of the inner vertical part 72, and a similar second securing flange 84 is formed by a lower portion of the outer vertical part 73. The securing flanges 82, 84 extend at a generally right angle in relation to the vertical parts 72, 73, respectively. Once installed, the flange 82 extends along the roof substructure 60 a distance from the line 64. The first securing flange 82 is secured to the roof substructure 60 by a mechanical means, such as nails or screws 86. In this position, the first securing flange 82 is sandwiched between the roof substructure 60 and the roofing material 68.

The second securing flange 84 is provided with an indentation 85 formed adjacent a distant end 89 of the securing flange 84, similar to the indentation 43 of the first embodiment of this invention. The indentations 43 and 85 allow better sealing of the ends 45, 89 to the roofing membranes. Similarly to the end 45, the end 89 can be cut an angle.

The end 89 is placed over the roofing material 68, substantially parallel to the first securing flange 82. An adhesive material 87 can be deposited between the roofing material 68 and the second securing flange 84. A mechanical securing means, such as nails or screws 88 is inserted through aligned openings in the roofing material 68, the flanges 82, 84 and the roof substructure 60, thus securing the flashing assembly 70 to the roof The nail can be driven through the adhesive strip 87.

The flashing assembly of the instant invention is a simplified system with a minimal number of components. It eliminates the need for cant strips, cutting and adhering of several pieces of material to the parapet wall. The system of the present invention protects the roof. If the parapet wall were to be blown down, the wall would break from the flashing at the top edge where silicone adhesive has been applied, leaving the flashing secured to the roof. This feature is in contrast to conventional installations where the parapet wall, if blown down, tears the edge of the roof away, thereby exposing the structure to water damage.

When compared to conventional installation using tar material, the instant assembly is clean and neat, requiring only silicone adhesive for securing the roofing material to the parapet wall and the flashing assembly.

The flashing assemblies 10 and 70 can be formed of a rigid material, such as non-corrosive metal, most preferably aluminum. Alternatively, the flashing assemblies can be formed of molded plastic. Such materials are rust-resistant and can be bent to create the necessary flanges.

Many changes and modifications can be made in the design of the present invention without departing from the spirit thereof. I therefore pray that my rights to the present invention be limited only by the scope of the appended claims.

I claim:

1. A method of reinforcing an interface defined between a roof and a portion of a building wall, wherein said roof comprises a roof substructure and a roofing membrane covering the roof substructure, the method comprising the steps of:

providing a flashing assembly comprising a first member configured for securing along the interface between the roof and the building wall, said first member having an inner vertical part, a locking flange extending at a right angle to the inner vertical part, an outer vertical part extending in a substantially parallel orientation to the inner vertical part, and a second member configured for covering an upper part of the first member;

forming said outer vertical part with a sealing flange oriented in a direction opposite said locking flange, and providing said second member with a channel for receiving said sealing flange;

positioning the first member such that the inner vertical part and the outer vertical part extend along the building wall, while the locking flange is fitted between the roof substructure and the roofing membrane;

securing the locking flange to the roof substructure;

positioning the second member over the upper part of the first member and over at least a portion of the roofing membrane; and securing the second member to the roofing membrane, the locking flange and the roof substructure.

2. The method of claim 1, further comprising a step of forming an integral outwardly inclined flange near a bottom portion of the first member for diverting water away from the building wall.

* * * * *